US010942535B2

(12) United States Patent
Sivaraj et al.

(10) Patent No.: US 10,942,535 B2
(45) Date of Patent: Mar. 9, 2021

(54) OPERATIONAL AMPLIFIER WITH CURRENT LIMITING CIRCUITRY

(71) Applicant: NXP USA, Inc., Austin, TX (US)

(72) Inventors: Mahraj Sivaraj, Austin, TX (US); John Pigott, Phoenix, AZ (US)

(73) Assignee: NXP USA, Inc., Austin, TX (US)

( * ) Notice: Subject to any disclaimer, the term of this patent is extended or adjusted under 35 U.S.C. 154(b) by 89 days.

(21) Appl. No.: 16/521,762

(22) Filed: Jul. 25, 2019

(65) Prior Publication Data

US 2021/0026383 A1 Jan. 28, 2021

(51) Int. Cl.

| | |
|---|---|
| ***G05F 1/46*** | (2006.01) |
| ***G05F 1/575*** | (2006.01) |
| ***G05F 3/20*** | (2006.01) |

(52) U.S. Cl.

CPC ..... *G05F 1/461* (2013.01); *G05F 1/575* (2013.01); *G05F 3/205* (2013.01)

(58) Field of Classification Search

CPC ..... G05F 1/461; G05F 1/575; G05F 3/205
See application file for complete search history.

(56) References Cited

U.S. PATENT DOCUMENTS

| | | | | |
|---|---|---|---|---|
| 5,384,549 | A | 1/1995 | Araki | |
| 6,157,176 | A * | 12/2000 | Pulvirenti | G05F 1/565 323/266 |
| 8,289,009 | B1 * | 10/2012 | Strik | G05F 1/575 323/272 |
| 8,912,849 | B2 | 12/2014 | Sheng | |
| 2012/0038332 | A1 * | 2/2012 | Lin | G05F 1/575 323/277 |
| 2013/0027010 | A1 * | 1/2013 | Groeneweg | G05F 1/575 323/280 |
| 2014/0266385 | A1 * | 9/2014 | Pigott | H03K 19/018521 327/333 |
| 2019/0258283 | A1 * | 8/2019 | Pishdad | G05F 1/575 |

* cited by examiner

*Primary Examiner* — Kyle J Moody
*Assistant Examiner* — Lakaisha Jackson
(74) *Attorney, Agent, or Firm* — Charlene R. Jacobsen

(57) ABSTRACT

A method for current limiting an operational amplifier includes sensing a first current through a first branch of the operational amplifier. The first branch conducts the first current from a limited current supply connected to an operational amplifier output. The first current is compared to a reference current to generate a regulation signal. A variable current source is controlled with the regulation signal. An output current of a transconductance amplifier is limited with the variable current source to limit the first current in response thereto.

20 Claims, 8 Drawing Sheets

OPERATIONAL AMPLIFIER WITH CURRENT LIMITING CIRCUITRY

FIELD

This disclosure relates generally to operational amplifiers, and more specifically to preventing a brown out condition of an operational amplifier in a Low Drop Out Voltage Regulator.

BACKGROUND

Operational amplifiers ("op-amps") may be used in Low Drop Out (LDO) voltage regulators to provide higher bandwidth by boosting a differential input current. This higher bandwidth is required to meet certain load regulation requirements of the LDO voltage regulator. However, certain operating conditions of the LDO voltage regulator will cause the op-amp to sink a substantial amount of current from a current limited supply that will result in a brown out condition on that supply.

The brown out condition is aggravated when the current limited supply is shared amongst several LDO voltage regulators, as may occur in a Power Management Integrated Circuit (PMIC). Furthermore, in certain applications, a brown out on multiple LDO voltage regulators will result in an unsafe condition when the PMIC is intolerant to undervoltage events resulting from the brown out.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Various embodiments described herein provide for current limiting of an op-amp to prevent brown out, for example in an LDO voltage regulator. In example embodiments, active and continuous regulation of the loading of a limited current supply (e.g., a charge pump), is achieved by limiting an output of a transconductance amplifier with a variable current source, wherein the output of the transconductance amplifier is mirrored to define the loading of the limited current supply. The variable current source is controlled by comparing a sensed loading of the current limited supply to a current reference.

In one embodiment, a current limiting circuit limits a maximum allowable current to be sourced by the limited current supply, thereby preventing a brown out condition of the supply voltage. In one example, the op-amp is a high bandwidth op-amp capable of sourcing sufficient current to meet regulation requirements. During startup a large differential voltage exists at the input of the op-amp (e.g. during the application of power to the circuit), or during an over current event. For example, during startup or over current events, the current limiting circuitry limits the current that the limited current supply sources, thus preventing a voltage drop on the supply, which could otherwise adversely affect other LDO circuitry sharing the same limited current supply. Such current limiting occurs within the op-amp, not at the final output driver of the LDO voltage regulator.

Figure 1:
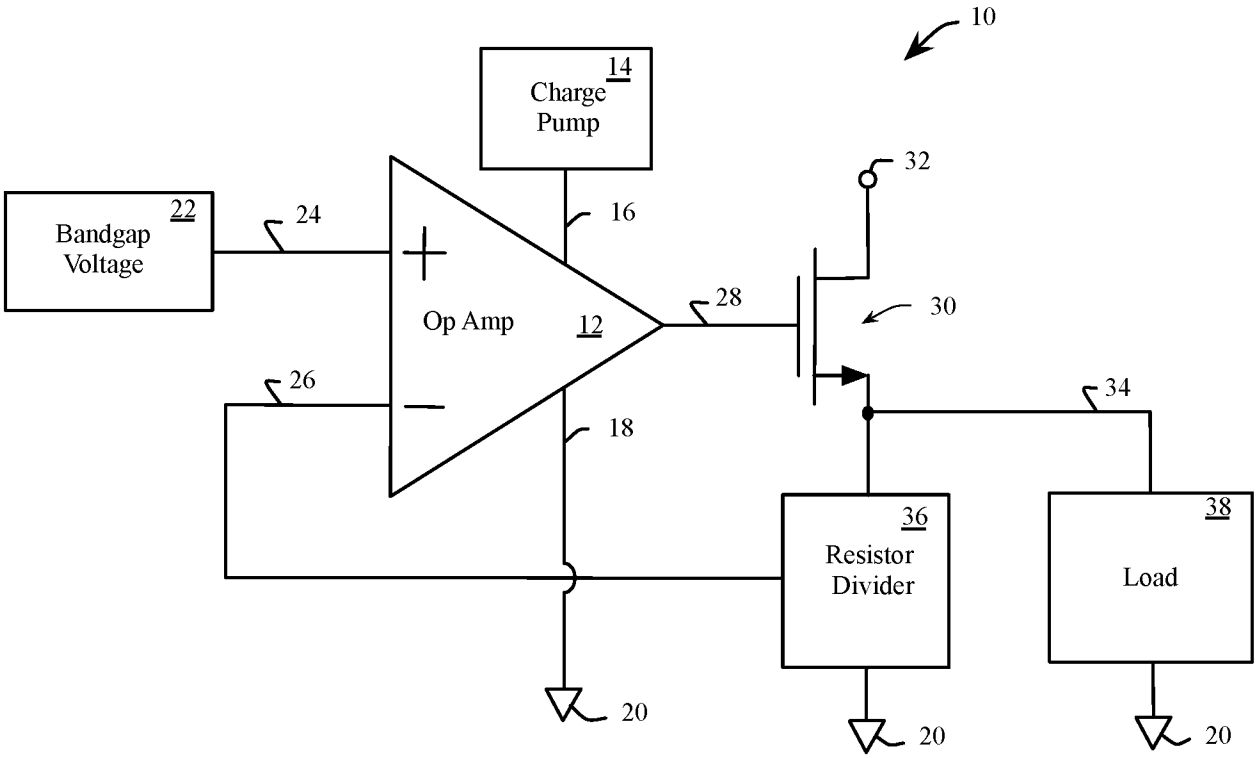
FIG. 1 is a schematic view of functional blocks of an example embodiment of an LDO voltage regulator.

FIG. 1 shows an example embodiment 10 of an LDO voltage regulator comprising an op-amp 12. The op-amp 12 is supplied by charge sourced from a charge pump 14 (e.g., a limited current supply), through a net 16, and by charge sunk through a net 18 to a ground 20. In some embodiments, the ground 20 is at a zero volt potential. A bandgap voltage 22, (or "reference input"), is generated by a bandgap reference or similar voltage reference having minimal dependence on fabrication process, supply voltage or operating temperature. The bandgap voltage 22 is connected to a positive input of the op-amp 12 through a net 24.

The op-amp 12 compares a voltage on a net 26 with the bandgap voltage 22 on the net 24 to generate an output on a net 28. The output of the op-amp 12 drives a Field Effect Transistor (FET) 30 in a source follower configuration. The FET 30 is connected between a supply 32 and a net 34. The source output of the FET 30 on the net 34 is divided by a resistor divider 36, connected to the ground 20, to generate a feedback voltage on the net 26. The source output of the FET 30 also supplies current (or "drives") the load 38, connected to the ground 20. In one embodiment, the FET 30 is an N-channel FET (NFET).

Figure 2:
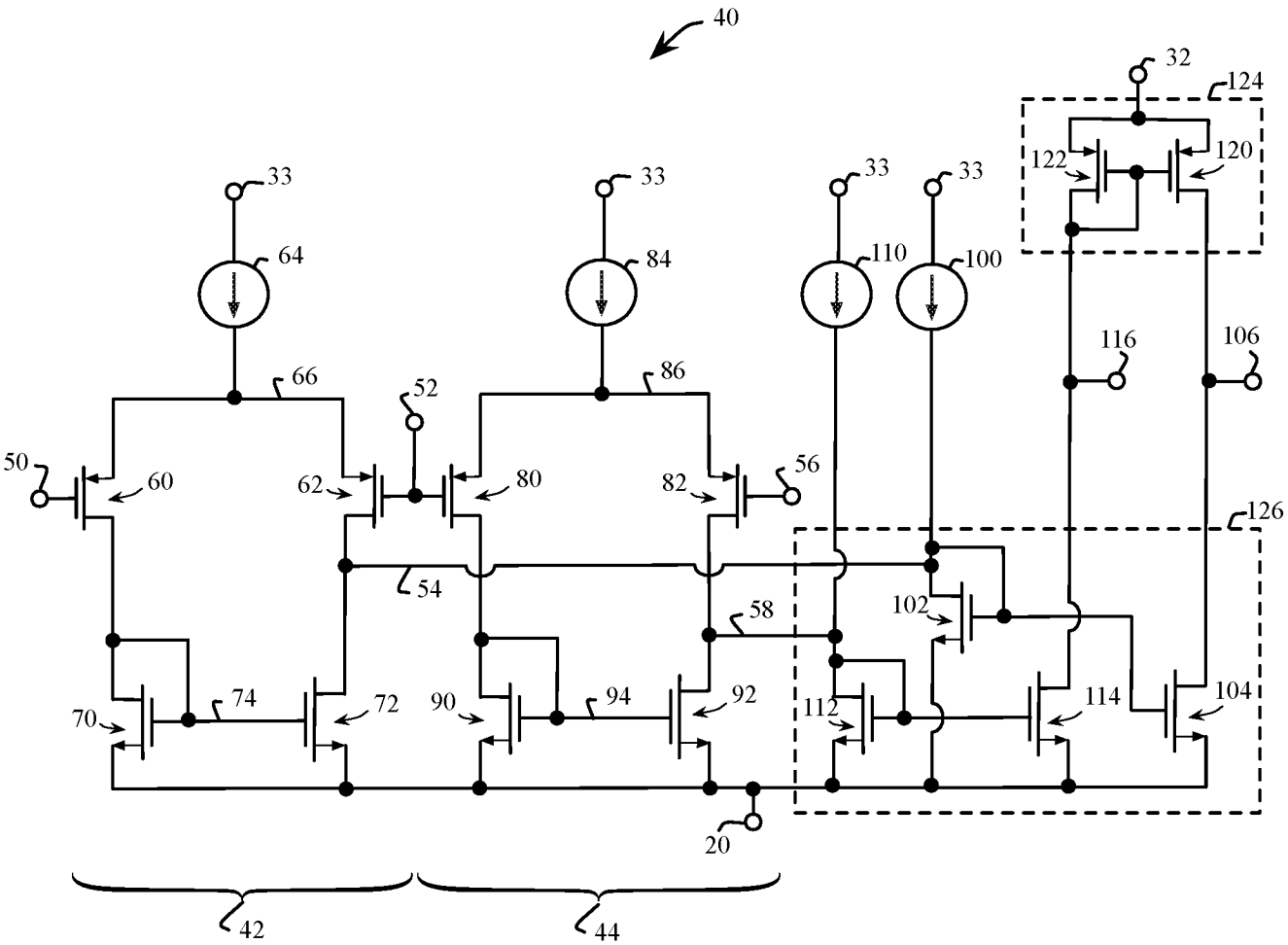
FIG. 2 is a schematic view of a device level implementation of the example embodiment of FIG. 1.

FIG. 2 is a device (e.g., transistor) level illustration of an example embodiment 40 of an LDO voltage regulator, similar to the embodiment 10 of FIG. 1. The embodiment 40 includes a first transconductance amplifier 42 and a second transconductance amplifier 44. The first transconductance amplifier 42 amplifies a difference between an input 50 and an input 52 to generate an output 54. The second transconductance amplifier 44 amplifies a difference between the input 52 and an input 56 to generate an output 58. In one example embodiment, the input 52 is connected to a bandgap reference and the inputs 50 and 56 are connected to respective inputs.

The first transconductance amplifier 42 includes a differential pair formed by P-channel FETs (PFETs) 60 and 62, and gated by the inputs 50 and 52 respectively. The PFETs 60 and 62 are supplied by a current source 64 connected between a supply 33 and a common source net 66. The first transconductance amplifier 42 further includes a current mirror formed by NFETs 70 and 72 with a common gate net 74 connected to a drain of the NFET 70. The respective source terminals of the NFETs 70 and 72 are connected to the ground 20.

The second transconductance amplifier 44 includes a differential pair formed by PFETs 80 and 82, and gated by the inputs 52 and 56 respectively. The PFETs 80 and 82 are supplied by a current source 84 connected between the supply 33 and a common source net 86. The second transconductance amplifier 44 further includes a current mirror formed by NFETs 90 and 92 with a common gate net 94 connected to a drain of the NFET 90. The respective source terminals of the NFETs 90 and 92 are connected to the ground 20.

A current source 100 is connected between the supply 33 and a drain of an NFET 102. The NFET 102 forms a current mirror with an NFET 104, with the common gate net (e.g., the output 54), connected to a drain terminal of the NFET 102. The NFETs 102 and 104 have their respective source terminals connected to the ground 20. A drain of the NFET 104 is connected to an output 106.

A current source 110 is connected between the supply 33 and a drain of an NFET 112. The NEFT 112 forms a current mirror with an NFET 114, with the common gate net (e.g., the output 58), connected to a drain terminal of the NFET 112. The NFETs 112 and 114 have their respective source terminals connected to the ground 20. A drain of the NFET 114 is connected to an output 116.

The outputs 106 and 116 are connected to respective drain terminals of PFETs 120 and 122. The source terminals of PFETs 120 and 122 are connected to the supply 32. The gate of the PFET 122 is connected to the source of the PFET 122 (e.g., the output 116), thereby forming a current mirror with the PFET 120. The PFETs 120 and 122 are high voltage devices 124. The NFETs 102, 104, 112 and 114 are high voltage devices 126.

In one example embodiment of FIG. 2, the following results in a brown out event. The supply 32 supplies 12V, the supply 33 supplies 1.5V, the current sources 64 and 84 supply 15 μA, the current sources 100 and 110 supply 1 μA and the PFETs 120 and 122 for a limited current supply (e.g., a charge pump) are limited to 15 μA. A bandgap reference is connected to the input 52. A large differential input between the inputs 50 and 56 results in up to 15 μA of current injected into FETs 112 and 102. The injected current into FETs 112 and 102 are summated with the respective current sources 110 and 100, each providing an additional 1 μA of current. Accordingly, NFETs 114 and 104 will each draw 16 μA of mirrored current and the current mirror consisting of PFETs 122 and 120 will be required to consume 32 μA, thus exceeding the charge pumps limit of 15 μA. Consequently, the supply 32 will drop in voltage thereby resulting in an undervoltage event or a "brown out."

Figure 3:
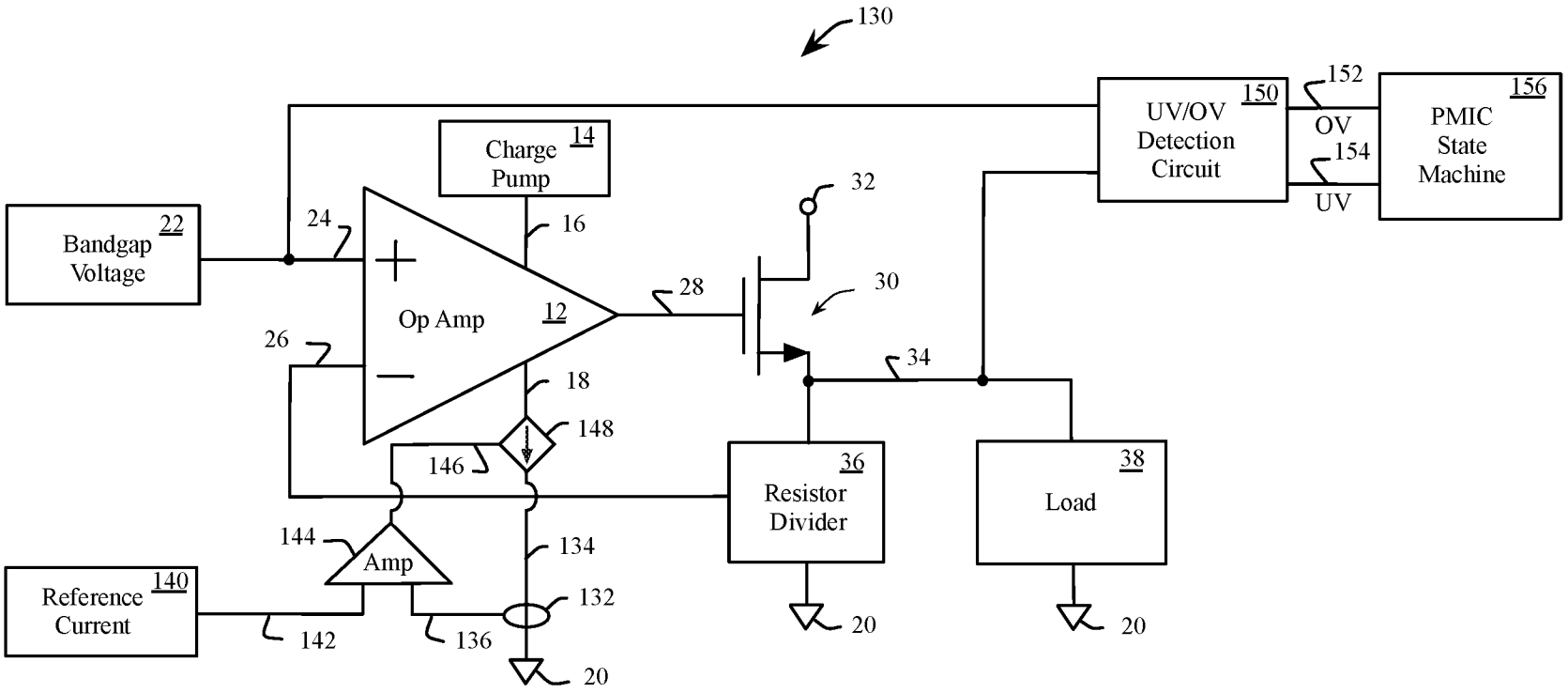
FIG. 3 is a schematic view of functional blocks of an LDO voltage regulator in accordance with an example embodiment of the present disclosure.

FIG. 3 shows an example embodiment 130 of an LDO voltage regulator with improvements to prevent the brown out condition described with respect to FIG. 1 and FIG. 2. The example embodiment 130 includes a current sensor 132 for sensing a current between the net 134 and the ground 20. In one embodiment, the current sensor 132 includes a current mirror for replicating thee current flowing from the net 134 and the ground 20. In another embodiment, the current sensor 132 uses a resistive network for sensing current.

The current sensor 132 generates a current on the net 136. A reference current circuit 140 generates a reference current on the net 142. An amplifier 144 compares the current on the net 136 with the reference current on the net 142 to generate a regulation signal on the net 146. The regulation signal controls a variable current source 148 to limit a current drawn from the charge pump 14, (or similarly a limited current supply), by the op-amp 12. In one embodiment, the variable current source 148 is a voltage controlled current source. In another embodiment, the variable current source 148 is a FET. In another embodiment, the amplifier 144 compares two voltage inputs generated by alternative embodiments of the reference current circuit 140 and the current sensor 132.

In the example embodiment 130, either an undervoltage (UV) or an overvoltage (0V) is detected by a UV/0V detection circuit 150, by comparing a reference voltage generated on the net 24 by the bandgap voltage 22 and the load voltage on the net 34. The UV/0V detection circuit 150 generates either the 0V flag 152 or the UV flag 154 in response to respective overvoltage and undervoltage events. A Power Management Integrated Circuit (PMIC) state machine 156 responds to either the 0V flag or the UV flag. In one embodiment, the PMIC state machine 156 responds to the UV flag 154 by driving the voltage regulator system into a safe state. In one embodiment, an additional flag is asserted in response to the safe state, wherein the flag controls additional circuitry (e.g., a micro control unit), using the embodiment 130. In another embodiment, the voltage regulator is shut down in response to the safe state.

Figure 4:
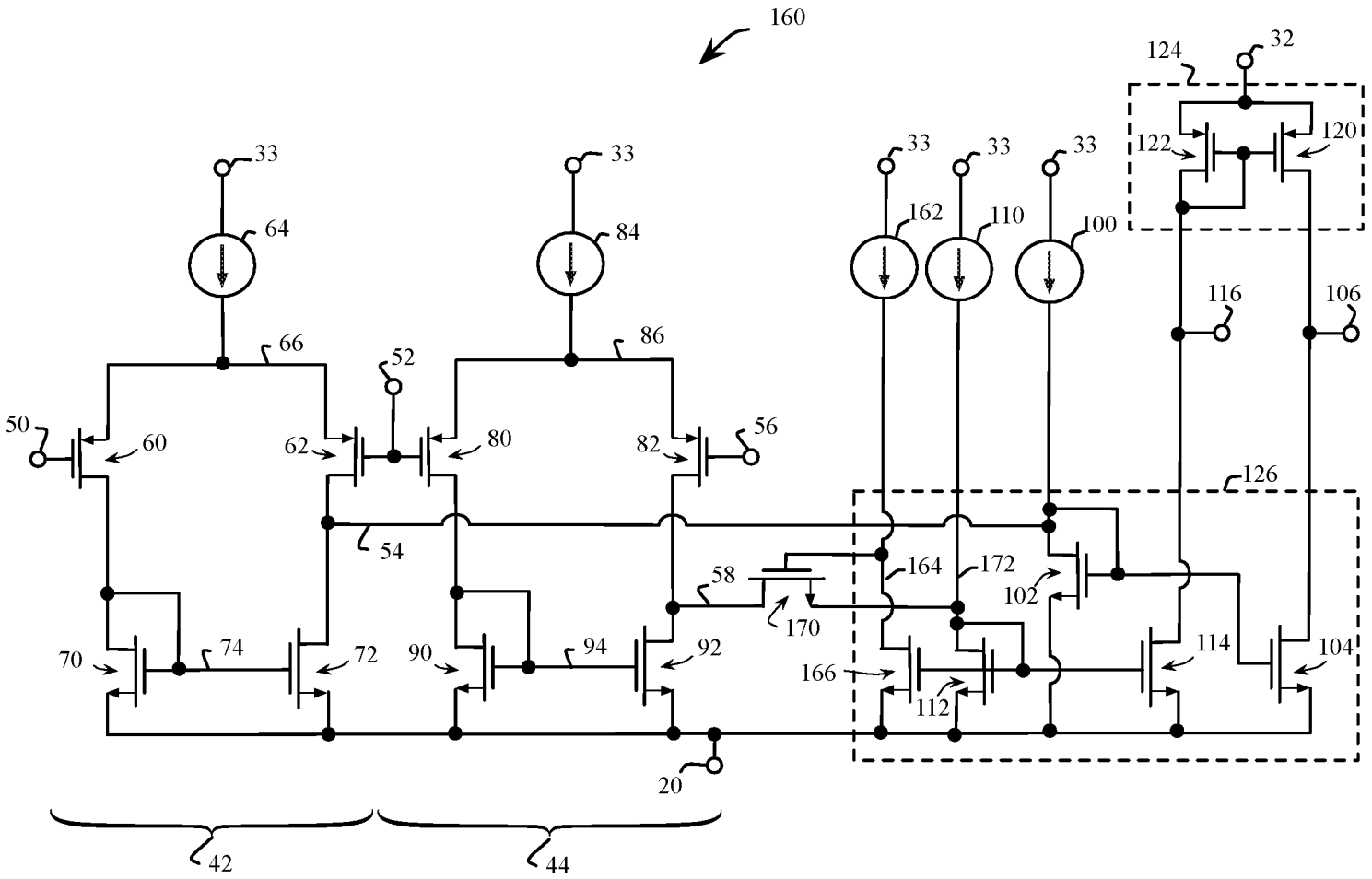
FIG. 4 is a schematic view of a device level implementation of the example embodiment of FIG. 3 in accordance with the present disclosure.

FIG. 4 shows an example embodiment 160 of a device level implementation of the LDO voltage regulator shown in FIG. 3. The embodiment 160 includes a current source 162 connected between the supply 33 and a net 164. An NFET 166 is connected between the net 164 and the ground 20. An NFET 170 is disposed between the output 58 of the second transconductance amplifier 44 and a net 172 connected to the gate and drain terminals of the NFET 112. With reference to FIG. 3 and FIG. 4, the current source 162 provides reference current, similar to the reference current circuit 140. The NFET 112 senses the charge pump current through a current mirror with the NFET 114. The combination of the current source 162 and the NFET 112 form an amplifier, similar to the amplifier 144, to control the NFET 170, similar to the variable current source 148.

Figure 5:
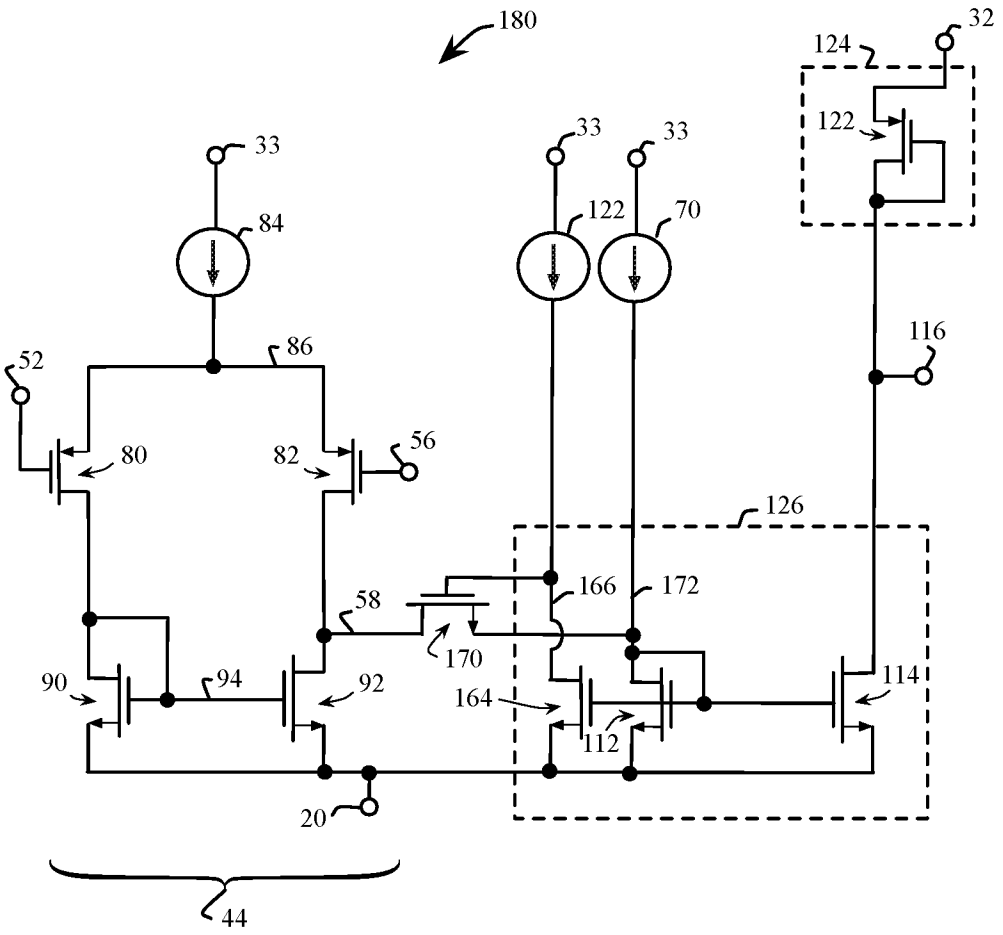
FIG. 5 is a schematic view of another device level implementation of the example embodiment of FIG. 3 in accordance with the present disclosure.

The NFET 170 regulates the current through the NFET 112, which controls the current through NFET 114 (due to the current mirror configuration), and thus the current through the charge pump. The feedback loop formed by sensing and regulating the charge pump current provides a stable current limitation of the charge pump over temperature and fabrication process variations. FIG. 5 with continued reference to FIG. 4 shows an example embodiment 180 based on a single ended version of the embodiment 160 of FIG. 4, with a similar operation.

Figure 6:
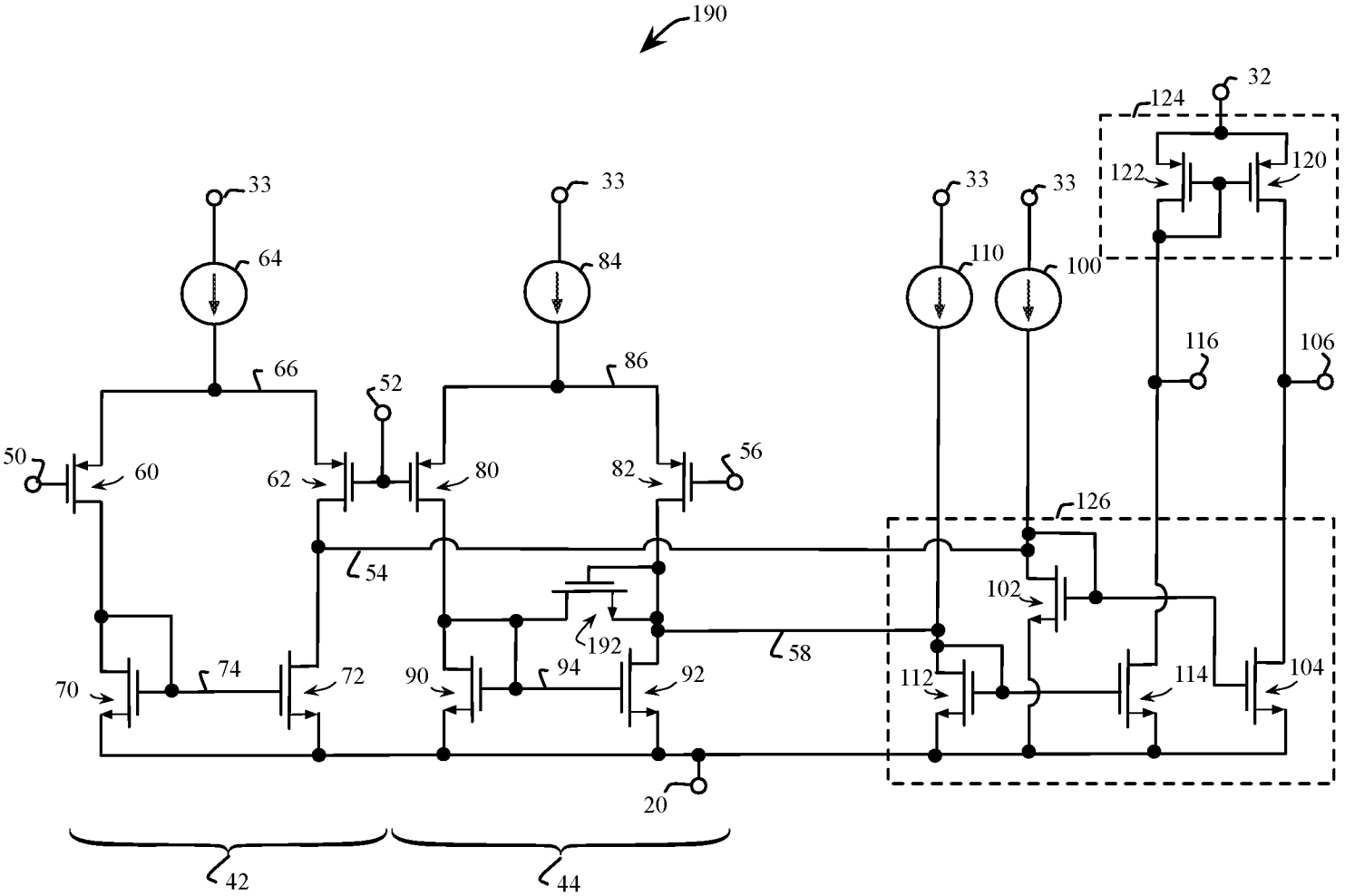
FIG. 6 is a schematic view of another device level implementation of the example embodiment of FIG. 3 in accordance with the present disclosure.

FIG. 6 shows an example embodiment 190 of an LDO voltage regulator. With reference to FIG. 2, FIG. 4 and FIG. 6, in the embodiment 190, a feedback regulation device (e.g., variable current source) is formed by an NFET 192. The NFET 192 includes a drain and source terminal connected between the net 94 and the output 58 respectively. A gate of the NFET 192 is connected to the output 58. In contrast to the embodiment 160 of FIG. 4, the embodiment 190 includes the variable current source within the second transconductance amplifier 44. The NFET 192 results in a higher sensitivity to process and temperature variations, compared to the embodiment 160, which can lead to parametric yield loss. Advantageously, the embodiment 190 requires fewer components than the embodiment 160, specifically the current source 162 and the NFET 166.

Figure 7:
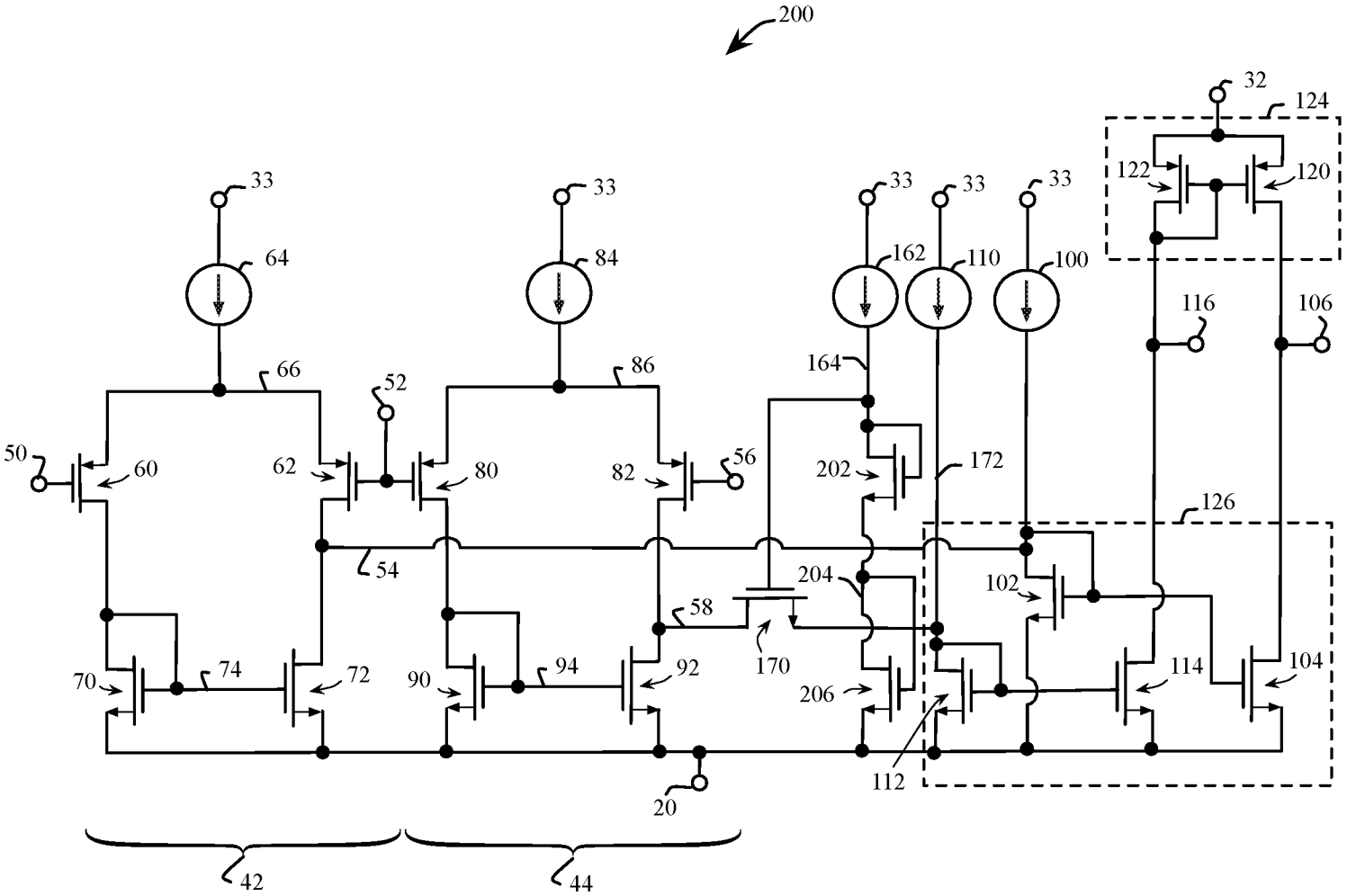
FIG. 7 is a schematic view of another device level implementation of the example embodiment of FIG. 3 in accordance with the present disclosure.

FIG. 7 shows an example embodiment 200 of an LDO voltage regulator. With reference to FIG. 2, FIG. 4 and FIG. 7, the embodiment 200, uses a similar variable current source based on the NFET 170, to regulate the output current of the second transconductance amplifier 44 between the output (e.g., regulated output) 58 and the net 172 of the current mirror formed by NFETs 112 and 114. In contrast to the embodiment 160 of FIG. 4, the embodiment 200 replaces the NFET 166 used to perform the function of the current sensor 132 of FIG. 3, with a pair of diode connected FETs. Specifically, an NFET 202 is connected between the net 164 and a net 204, with a gate and a drain of the NFET 202 shorted together. An NFET 206 is connected between the net 204 and the ground 20, with a gate and a drain of the NFET 206 shorted together. In contrast to the embodiment 160 of FIG. 4, the embodiment 200 suffers from a resistance variation of the NFET 170 with respect to variations in temperature and fabrication process variations.

Figure 8:
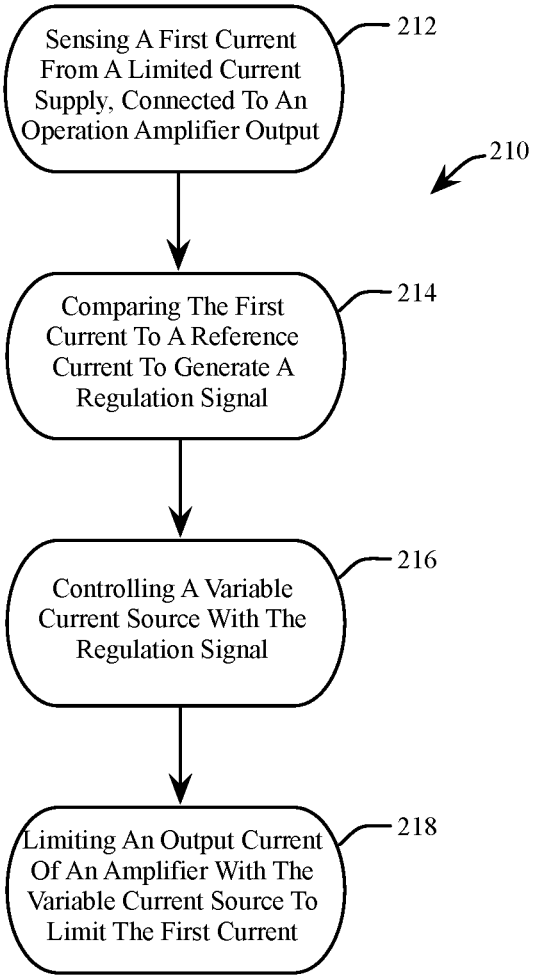
FIG. 8 is a flowchart representation of a method for current limit op-amp in accordance with an example embodiment of the present disclosure.

FIG. 8 with reference to FIG. 3 shows a method 210 for limiting the supply current of an op-amp included in an LDO voltage regulator. At 212, a first current is sensed from a limited current supply (e.g., a charge pump 14 sensed by the current sensor 132). At 214, the first current (e.g., on net 136) is compared to a reference current (e.g. on net 142) to generate a regulation signal (e.g., on net 146). At 216, a variable current source (e.g., 148) is controlled with the regulation signal. At 218, an output current of an amplifier (e.g. 12) is limited with the variable current source to limit the first current.

As will be appreciated, embodiments as disclosed include at least the following. In one embodiment, an apparatus comprises a limited current supply connected to a first branch and an operational amplifier output. A current sensor is coupled to the first branch, wherein the current sensor is configured to sense a first current conducted by the first branch. An amplifier is connected to a reference current and the current sensor. The amplifier is configured to generate a regulation signal proportional to a difference between the reference current and the first current. A variable current source is controlled by the regulation signal. A transconductance amplifier is decoupled from a second branch of the operational amplifier by the variable current source, wherein a second current of the second branch determines the first current.

In another embodiment, a method for current limiting an operational amplifier comprises sensing a first current through a first branch of the operational amplifier. The first branch conducts the first current from a limited current supply connected to an operational amplifier output. The first current is compared to a reference current to generate a regulation signal. A variable current source is controlled with the regulation signal. An output current of a transconductance amplifier is limited with the variable current source to limit the first current in response thereto.

In another embodiment, an apparatus comprises a charge pump connected to an operational amplifier output and a first field effect transistor (FET). A second FET is biased by a summation current of a first reference current source and a regulated output. The second FET forms a first current mirror with the first FET, wherein a first current conducted by the first FET equals the summation current. A current sensor is configured to sense the first current with a second current mirror. A third FET is connected between a transconductance amplifier output and the regulated output, wherein a gate of the third FET is connected to an output of the current sensor, thereby limiting the first current in response thereto.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An apparatus comprising:

a limited current supply connected to a first branch and an operational amplifier output;

a current sensor coupled to the first branch, wherein the current sensor is configured to sense a first current conducted by the first branch;

an amplifier connected to a reference current and the current sensor, the amplifier configured to generate a regulation signal proportional to a difference between the reference current and the first current;

a variable current source controlled by the regulation signal; and a transconductance amplifier decoupled from a second branch of the operational amplifier by the variable current source, wherein a second current of the second branch determines the first current.

2. The apparatus of claim 1 wherein the limited current supply is a charge pump.

3. The apparatus of claim 1 further comprising an undervoltage detection circuit connected to a reference input of the transconductance amplifier and a load coupled to the operational amplifier output, the undervoltage detection circuit configured to activate a status flag in response to a first voltage of the load decreasing below a second voltage of the reference input.

4. The apparatus of claim 3 further comprising a power management circuit configured to enter a safe state in response to the status flag.

5. The apparatus of claim 1 wherein the variable current source is a field effect transistor.

6. A method for current limiting an operational amplifier comprising:

sensing a first current through a first branch of the operational amplifier, the first branch conducting the first current from a limited current supply connected to an operational amplifier output;

comparing the first current to a reference current to generate a regulation signal;

controlling a variable current source with the regulation signal; and limiting an output current of a transconductance amplifier with the variable current source to limit the first current in response thereto.

7. The method of claim 6 further comprising activing an undervoltage status flag in response to the first current decreasing below the reference current.

8. The method of claim 7 further comprising entering a safe state with a power management circuit in response to the undervoltage status flag being activated.

9. The method of claim 8 wherein the safe state comprises deactivating the operational amplifier output.

10. The method of claim 8 wherein the safe state comprises activating a system flag.

11. The method of claim 6 wherein limiting the output current is in response to a start up condition of the operational amplifier.

12. The method of claim 6 wherein limiting the output current is in response to an excessive current conducted through a load coupled to the operational amplifier output.

13. The method of claim 6 further comprising sharing the limited current supply with a respective operational amplifier of each of a plurality of Low Drop Out voltage regulators.

14. The method of claim 6 wherein the limited current supply generates the first current by charge pumping.

15. The method of claim 6 wherein controlling the variable current source comprises controlling a gate of a field effect transistor.

16. The method of claim 6 wherein sensing the first current comprises sensing a second current, the first current mirroring the second current and the output current of the transconductance amplifier limiting the second current.

17. An apparatus comprising:

a charge pump connected to an operational amplifier output and a first field effect transistor (FET);

a second FET biased by a summation current of a first reference current source and a regulated output, the second FET forming a first current mirror with the first FET, wherein a first current conducted by the first FET equals the summation current;

a current sensor configured to sense the first current with a second current mirror; and a third FET connected between a transconductance amplifier output and the regulated output, wherein a gate of the third FET is connected to an output of the current sensor, thereby limiting the first current in response thereto.

18. The apparatus of claim 17 wherein the current sensor comprises a fourth FET forming the second current mirror with the first FET, the fourth FET biased with a second reference current source, wherein a first reference current of the first reference current source equals a second reference current of the second reference current source.

19. The apparatus of claim 17 comprising a plurality of Low Drop Out (LDO) regulators, wherein the charge pump is shared with a respective operational amplifier of each of the LDO regulators.

20. The apparatus of claim 17 further comprising an undervoltage detection circuit connected to a reference input of the transconductance amplifier and a load coupled to the operational amplifier output, the undervoltage detection circuit configured to activate a status flag in response to a first voltage of the load decreasing below a second voltage of the reference input.

* * * * *